US005771521A

United States Patent [19]

McNamee

[11] Patent Number: 5,771,521

[45] Date of Patent: Jun. 30, 1998

[54] SANITARY BRUSH COVER SYSTEM

[76] Inventor: Brian J. McNamee, P.O. Box 676, Severna Park, Md. 21146

[21] Appl. No.: 588,376

[22] Filed: Jan. 18, 1996

[51] Int. Cl.[6] ..... A46B 17/04

[52] U.S. Cl. ..... 15/184; 15/247; 206/362.3

[58] Field of Search ..... 15/184, 247; 132/308–311; 206/362.2, 209.1, 362.3; 383/71

[56] References Cited

U.S. PATENT DOCUMENTS

| | | | |
|---|---|---|---|
| 1,179,800 | 4/1916 | Carswell . | |
| 1,283,403 | 10/1918 | Eustis | 206/209.1 |
| 1,298,041 | 3/1919 | Harris | 132/308 |
| 1,653,540 | 12/1927 | Bigoney . | |
| 1,827,654 | 10/1931 | Harper . | |
| 1,904,609 | 4/1933 | Bleadon . | |
| 2,172,600 | 9/1939 | Van Der Werth | 15/247 |
| 2,353,517 | 7/1944 | Spanel | 206/362.3 |
| 2,667,395 | 1/1954 | Ushanoff . | |
| 3,053,253 | 9/1962 | Liloia et al. . | |
| 3,200,427 | 8/1965 | Daley . | |
| 3,574,879 | 4/1971 | Werding . | |
| 3,884,227 | 5/1975 | Lutz et al. . | |
| 3,938,570 | 2/1976 | Stewart | 15/247 |
| 4,362,241 | 12/1982 | Williams . | |
| 4,384,382 | 5/1983 | Diamant | 15/247 |
| 4,768,887 | 9/1988 | Kimura | 383/71 |
| 5,139,142 | 8/1992 | Simon . | |
| 5,184,719 | 2/1993 | Gordon . | |
| 5,375,711 | 12/1994 | Bree et al. . | |

*Primary Examiner*—Terrence Till

*Attorney, Agent, or Firm*—Morton J. Rosenberg; David I. Klein; Jun Y. Lee

[57] ABSTRACT

A sanitary brush cover system (10) for breathably isolating the bristled portion (2) of a brush (1) from contaminant particles and organisms is provided. The sanitary brush cover system (10) comprises a shroud member (20) which substantially enshrouds the bristled portion (2) of a given brush (1). The shroud member (20) includes a flexible body portion (25) formed of an air-permeable composition which is substantially impermeable to the contaminant atmospheric particles and organisms from which the bristled portion (2) is to be protected. The shroud member (20) also includes an inlet portion (30) through which bristled portion (2) of brush (1) is received. The shroud member (20) has coupled thereto adjacent the inlet portion (30) a closure mechanism (40) for selectively closing and opening the inlet portion (30) to, thereby, substantially enclose the bristled portion (2) therewithin. In one embodiment, the air-permeable composition is a fibrous fabric typically employed in forming surgical masks.

8 Claims, 3 Drawing Sheets

SANITARY BRUSH COVER SYSTEM

BACKGROUND OF THE INVENTION

FIELD OF THE INVENTION

The subject sanitary brush cover system is generally directed to a removable and reusable brush covering system. More specifically, the sanitary brush cover system is a removable covering system for breathably isolating the bristled portion of a brush from particles and organisms that may contaminate that bristled portion.

In today's highly-interactive society interactive contact routinely occurs not only amongst inhabitants of a given locale, but amongst inhabitants of different cities, countries, and even continents. As a result, the average person's exposure to infectious diseases and ailments has increased dramatically both in scope and frequency. That reality, coupled with the medical community's inability to as yet develop adequate treatments for even the least serious, most common of such infectious diseases and ailments, has heightened the public's awareness of the benefits to be found in aggressive exercise of preventative measures.

One area peculiarly suited for the exercise of very simple, though effective, preventative measures is in oral hygiene. The persistently warm, moist environment to be found inside a person's mouth, together with the regular introduction therein of a seemingly never-ending variety of food and drink substances for ingestion, make for an ideal place of incubation for many infectious diseases and ailments. Moreover, the cuts and sores which invariably occur on the tongue, gum, and inner walls of the mouth from contact with hot or abrasive substances, from impact by mouth cleaning implements, or from inadvertent biting not only open up additional incubation areas, but also provide incubated diseases and ailments with unimpeded access to the given person's circulatory system. The spread of such diseases and ailments to other parts of the person's body is in many cases, therefore, quite swift and quite thorough.

The general public is for these reasons often advised by various professional communities to conscientiously exercise good oral hygiene. In particular, many are advised to regularly substitute their old toothbrushes with new replacements. What is seemingly overlooked or lost in this advice, however, is the importance of protecting the head, or bristled portion, of a toothbrush while it is being stored between uses.

Typically, a toothbrush is stored by being hung on a rack, supported on a stand, or simply laid on a counter with no measures being taken to cover its bristled portion. Thus, the bristles of that toothbrush which invariably make intimate contact with open cuts and sores inside a user's mouth during use, are left completely exposed to the immediately surrounding bathroom atmosphere, free to collect various contaminant particles and organisms that may be contained therein.

While products currently available from various commercial sources do attempt to cover all or portions of a toothbrush, they are generally intended for ornamental or containment/carrying purposes. Furthermore, those products are typically composed of an air-impermeable material with one or more ventilation openings. Such ventilation openings enable a recently-used brush to dry and thereby prevent the musty capture of moisture within the covering, but they also enable contaminant atmospheric particles and organisms, among other things, to freely enter. There is no brush covering system which, both, effectively encloses the entire bristled portion and enables the free passage of air to and from that enclosed bristled portion. There is, therefore, a need for a toothbrush covering system that is effective in breathably isolating the bristled portion of a toothbrush from contaminant atmospheric particles and organisms, yet is simple enough in structure and utilization to be widely available and widely used.

RELATED ART

It is well recognized that proper oral hygiene requires regular brushing of the teeth. Not as well recognized, but just as important to oral hygiene, is the importance of proper care of the toothbrush. Such care includes adequate drying of the brush after each use in order to prevent incubation of infectious diseases and ailments and careful storage of the brush between uses to prevent the introduction of atmospheric contaminant particles and organisms.

Toothbrush covers are known which protect the brush from atmospheric contaminant particles and organisms. Related art of which Applicant is aware includes U.S. Pat. Nos. 1,653,540; 5,139,142; 2,667,395; 3,574,879; 3,884,227; 3,575,711; 4,363,427; 3,053,253; and 5,184,719. None of these references, however, provide a compact, multiple use toothbrush cover which can simultaneously ventilate a covered toothbrush while protecting the toothbrush from atmospheric contaminant particles and organisms.

U.S. Pat. No. 1,653,540 is directed to a reusable toothbrush cover made from a protective celluloid. Such a package serves to prevent the introduction of atmospheric contaminant particles and organisms to a toothbrush but does not permit the brush to dry between uses. As a consequence, incubation of infectious diseases and ailments may occur.

U.S. Pat. No. 5,139,142 is directed to a toothbrush having ventilation ducts in an otherwise waterproof toothbrush cover. These ducts, however, are so large (up to 6.5 mm) so as to permit easy contamination of the brush from atmospheric particles and organisms. Moreover, although resealable, this cover is designed to last only up to ten days.

Similarly, U.S. Pat. No. 2,667,395 is directed to a toothbrush holder provided with ventilation through perforations. While this device is designed for a longer useful life than the device of the '142 reference, it is too bulky to be of practical use. As with the '142 reference, this device is also incapable of preventing contamination from atmospheric particles and organisms.

U.S. Pat. No. 3,574,879 provides a ventilation hole in a toothbrush cover and addresses the atmospheric contamination problem by providing a disinfecting cake or tablet within the cover. While such a scheme substantially resolves the atmospheric contamination problem, it unduly complicates an otherwise simple device.

Fibrous materials are known which simultaneously provide ventilation while filtering atmospheric particles and organisms. U.S. Pat. No. 3,884,227, for instance, is directed to an improved material for use in surgical masks. There is, however, no brush cover known employing such a material for the purposes and objectives realized in the present invention.

SUMMARY OF THE INVENTION

The subject sanitary brush cover system provides for a simple, yet effective, system for breathably isolating a bristled portion of a brush from various atmospheric particles and organisms that might collect in or otherwise contaminate its bristles. The subject system comprises a shroud member which substantially enshrouds the bristled portion of a given brush. The shroud member is formed with a body portion and an inlet portion, the body portion defining a brush chamber within which the bristled portion of the given brush is received and the inlet portion defining an opening through which the bristled portion is inserted to be received by the brush chamber. The body portion has at least one flexible panel formed of an air-permeable composition which is substantially impermeable to the contaminant atmospheric particles and organisms from which the bristled portion is to be protected. The subject system also includes a closure mechanism coupled to the shroud member for selectively closing and opening the inlet portion opening to, thereby, substantially enclose the brush chamber in selective manner.

In a preferred embodiment, the air-permeable composition of the shroud member's flexible panel is a fibrous fabric typically employed in surgical masks. The closure mechanism in that embodiment includes a pliable metallic band which is attached to the shroud member's flexible panel. Once the shroud member is fitted over the bristled portion of the given brush such that the bristled portion is received within its brush chamber, the metallic band may be deformed to collapse the inlet portion, in part, against the brush and thereby substantially enclose the brush chamber. As a substantial portion of the given brush may be covered by the shroud member, various indicia, including alpha numeric characters, graphic designs, predetermined color or luminescence, and identifiable texture may be formed thereon to enhance the identifiability of the given brush.

In an alternate embodiment, the closure mechanism is realized in the form of a bottom panel member coupled to the inlet portion of the shroud member to extend across the inlet portion opening. The bottom panel member includes a flexible portion having formed therein at least one slit to enable the insert of the bristled portion of the given brush to be inserted therethrough. With this configuration, a self-closing feature is realized in that insert of the bristled portion into the shroud member's brush chamber occurs only after that portion of the brush has sufficiently deflected the flexible portion of the bottom panel member adjacent its slit. The deflected flexible portion tends to oppose the deflection and substantially contiguously abuts that portion of the brush maintaining the deflection.

In another alternate embodiment of the subject sanitary brush system, the shroud member is adapted to extend across the upper opening of a brush stand within which a plurality of brushes may be supported. In that embodiment, the inlet portion of the shroud member is adapted to substantially contiguously engage the brush stand's rim portion. A closure mechanism is coupled to the shroud member for releasably securing that engagement. The closure mechanism is realized in the form of one or more pliable metallic bands attached to the shroud member adjacent the inlet portion. Once the shroud member is fitted in place over the upper opening of the given brush stand, the metallic band may be deformed accordingly to securely engage the brush stand's rim portion.

DESCRIPTION OF THE PREFERRED EMBODIMENT

Figure 1:
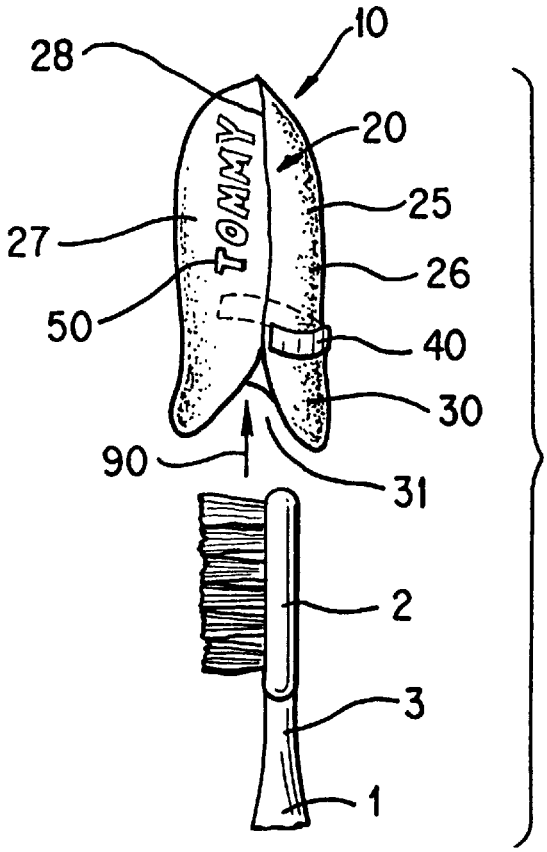
FIG. 1 is a perspective view of the preferred embodiment of the subject sanitary brush cover system illustrating a typical application.
Figure 2:
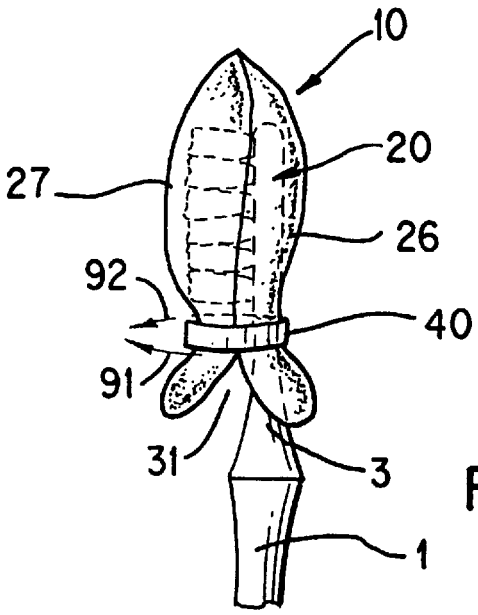
FIG. 2 is a perspective view of the preferred embodiment of the subject sanitary brush cover system illustrating the operation of the closure mechanism thereof.

Referring now to FIGS. 1 and 2, there is shown a sanitary brush cover system 10 for breathably isolating a bristled portion 2 of a toothbrush 1 from contaminant atmospheric particles and organisms. Sanitary brush cover system 10 generally comprises a shroud member 20 for enshrouding bristled portion 2 of brush 1 and a closure mechanism 40 for enclosing bristled portion 2 within shroud member 20 about a neck portion 3 of brush 1 once shroud member 20 is fitted in place.

Shroud member 20 is a hood-like device having an upper, or body, portion 25 and a lower, or inlet, portion 30 which respectively define an inner brush chamber and an opening 31 that provides access to the brush chamber. Shroud member 20 is formed by a pair of flexible panels 26, 27 fastened together along a panel joint 28 by sewn thread, adhesive, or any other comparable fastening mechanism, the choice of which is not important to the present invention. Preferably, both flexible panels 26, 27 are formed of a fibrous fabric typically utilized in surgical masks. Such a fabric is air-permeable, yet substantially impermeable to many contaminant atmospheric particles and organisms such as dust, bacteria, fungus, and the like. The structure and composition of surgical mask fabrics are well-known and serve as no part of the present invention. It is only important to the invention in this regard that the specific structure and composition of the material chosen for at least a portion of one or both flexible panels 26, 27 be sufficient to provide ventilating and filtering functions similar to those normally provided by the employed fabric in typical surgical mask applications.

Thus configured, shroud member 20 may receive within its brush chamber a wet bristled portion 2 of a recently-used brush 1 when that bristled portion 2 is inserted through inlet portion opening 31 as indicated by directional arrow 90. A user need not wait until bristled portion 2 is dry, nor take burdensome measures to dry that portion prior to inserting it into shroud member 20, as drying of the bristles will progress without significant hinderance, even with shroud member 20 enshrouding them.

Attached to one or both flexible panels 26, 27 of shroud member 20 is a closure mechanism 40 which, in the preferred embodiment, is simply a pliable metallic band. Pliable band 40 is attached to the outer surface of shroud member 20 at a point sufficiently proximal to inlet portion 30 such that when shroud member 20 is fitted over bristled portion 2 of brush 1, it partially encircles brush 1 at neck portion 3. Pliable band 40 is attached to the outer surface of shroud member 20 by use of an adhesive composition or other suitable fastening mechanism providing a sufficiently secure attachment that may endure repeated manipulations of pliable band 40. While pliable band 40 is preferably formed of a metallic composition, it may be formed of any other suitable composition possessing the necessary pliability and strength to endure those repeated manipulations, and to do so without significant loss of its mechanical properties.

Once shroud member 20 is in place over bristled portion 2 of brush 1, that portion may be substantially enclosed therein by deforming metallic band 40 as indicated by directional arrows 91, 92, to collapse flexible panels 26, 27 about neck portion 3 of brush 1. This substantially closes inlet portion opening 31 to effectively shut off free access of contaminant atmospheric particles and organisms to bristled portion 2 of brush 1. Brush 1 may then be stored indefinitely without fear of contamination by foreign atmospheric particles and organisms. When brush 1 is to be re-used, it may be quickly and conveniently uncovered by reversing the deformation of metallic band 40 and withdrawing bristled portion 2 from the brush chamber through inlet portion opening 31.

When fitted over bristled portion 2 of a brush 1, sanitary brush cover system 10 covers and may thus hide from view of a substantial portion of brush 1. Depending on how brush 1 is stored between uses, very little, if any, of the given brush 1 may be directly visible to a user. It is, therefore, preferable to form or apply on an outer surface portion of shroud member 20 predetermined indicia 50 for brush identification, as well as ornamental, purposes. Indicia 50 may take the form of alpha numeric characters, graphic designs, a predetermined color or luminescence, readily identifiable textures, and the like. Such indicia 50 aids the given user in selecting from among a plurality of brushes his or her own particular brush prior to use, and maybe more importantly, aids in preventing him or her from replacing onto bristled portion 2 of his or her particular brush after use another user's sanitary brush cover system 10.

Figure 3:
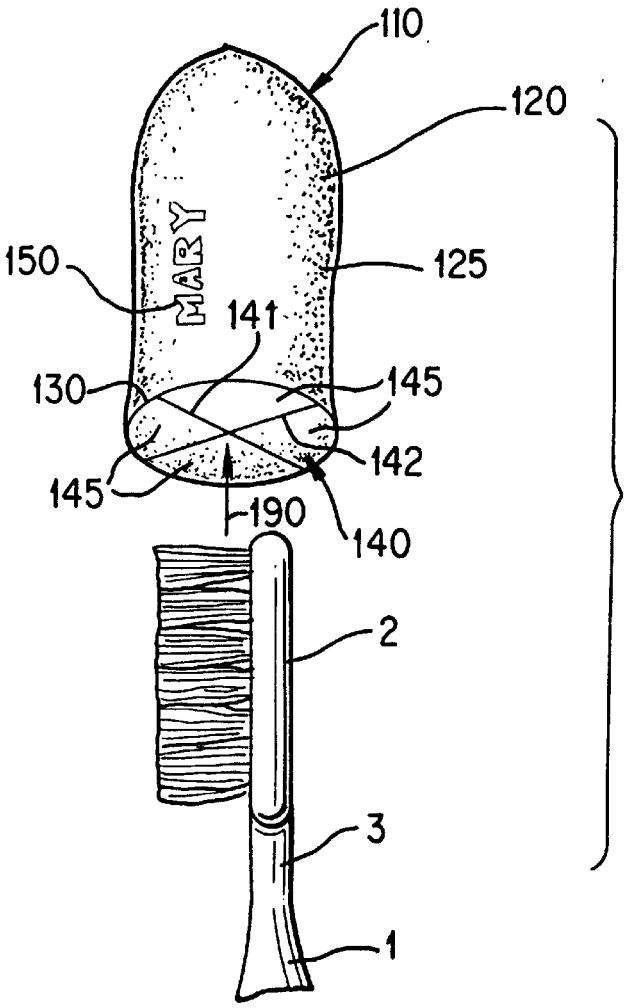
FIG. 3 is a perspective view of an alternate embodiment of the subject sanitary brush cover system illustrating a typical application.
Figure 4:
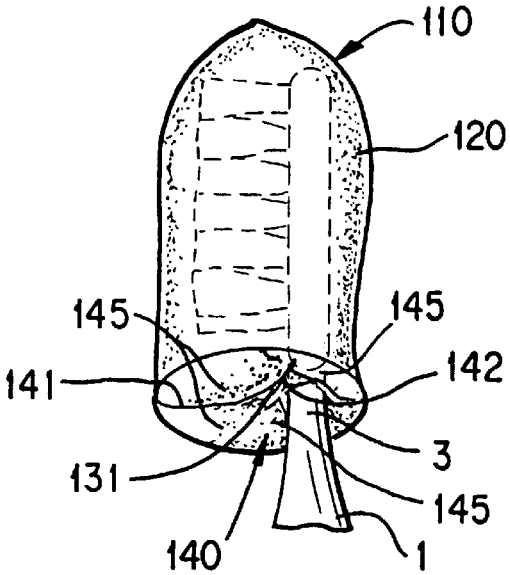
FIG. 4 is a perspective view of the alternate embodiment of the subject sanitary brush cover system shown in FIG. 3 illustrating the operation of the closure mechanism thereof.

Referring now to FIGS. 3 and 4, there is shown an alternate embodiment of the subject sanitary brush cover system 110. Sanitary brush cover system 110 of this embodiment comprises a shroud member 120 having a unitary body portion 125 defining a brush chamber for receiving bristled portion 2 of brush 1 therein. Body portion 125 is formed of the same fibrous fabric described in relation to the composition of flexible panels 26, 27 of the preferred embodiment shown in FIGS. 1 and 2.

Shroud member 120 includes an inlet portion 130 defining an opening 131 across which a bottom panel member 140 extends. Bottom panel member 140 is composed of a flexible material, and having a pair of crossed slits 141, 142 formed therein, serves as the closure mechanism for inlet portion opening 131 of shroud member 120. Slits 141, 142 define on bottom panel member 140 a plurality of flap portions 145 which, upon insertion of bristled portion 2 into shroud member 120 in the direction indicated by directional arrow 190, deflect upwards to expose inlet portion opening 131 and thereby accommodate passage of bristled portion 2 therethrough. A self-closing feature is realized by this configuration, for the upwardly-deflected flap portions 145 tend to oppose their deflections, substantially contiguously abutting that portion of brush 1 maintaining the deflections at a given instant in time.

After insert of the entire bristled portion 2 into the brush chamber of shroud member 120, flaps 145 substantially shut inlet portion opening 131, those portions free of deflecting contact with brush 1 returning to their undeflected portions and the remaining flap portions abutting neck portion 3 of brush 1. Bristled portion 2 of brush 1 is then substantially enclosed within the brush chamber of shroud member 120. It should be readily apparent that flap portions 145 facilitate convenient withdrawal of bristled portion 2 from the brush chamber of shroud member 120, as they simply deflect downward to accommodate such withdrawal.

While bottom panel member 140 need only be formed of a flexible material of suitable strength, it is preferable that the flexible material be the same fibrous, air-permeable material from which shroud member 120 is formed. This avoids any threat of detracting from the overall breathability attributable to sanitary brush cover system 110.

For identification, and possibly ornamental, purposes, indicia 150 may be formed on an outer surface portion of shroud member 120. As described in relation to indicia 50 in the preferred embodiment shown in FIGS. 1 and 2, indicia 150 may take any one of a variety of communicative forms.

Figure 5:
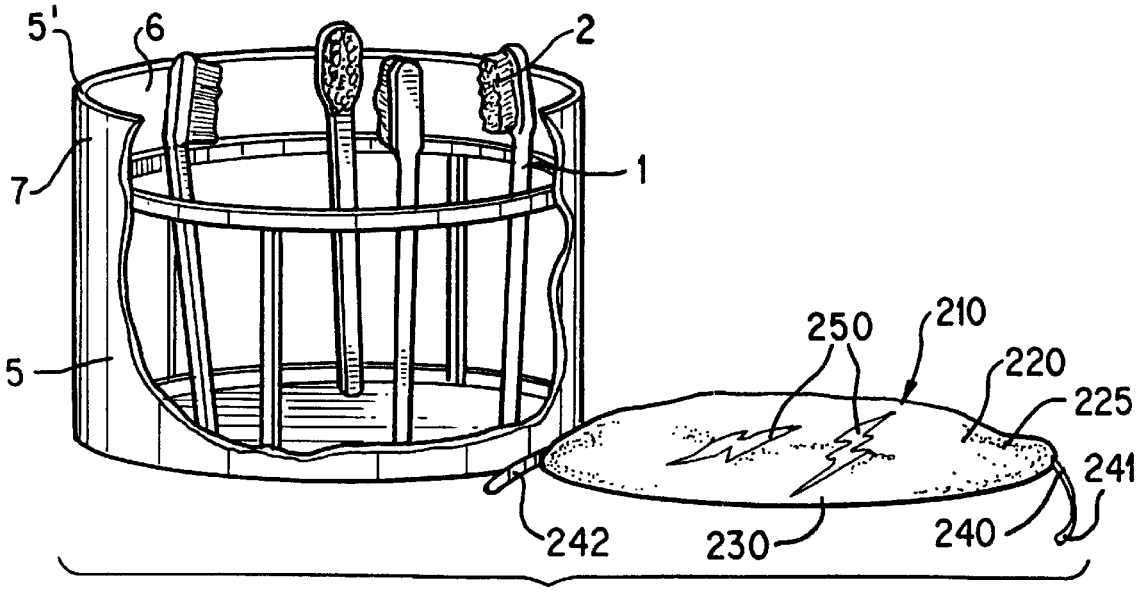
FIG. 5 is a perspective view of another alternate embodiment of the subject sanitary brush cover system illustrating a typical application; and, FIG. 6 is a perspective view of the alternate embodiment of the subject sanitary brush cover shown in FIG. 5 illustrating the operation of the closure mechanism thereof.
Figure 6:
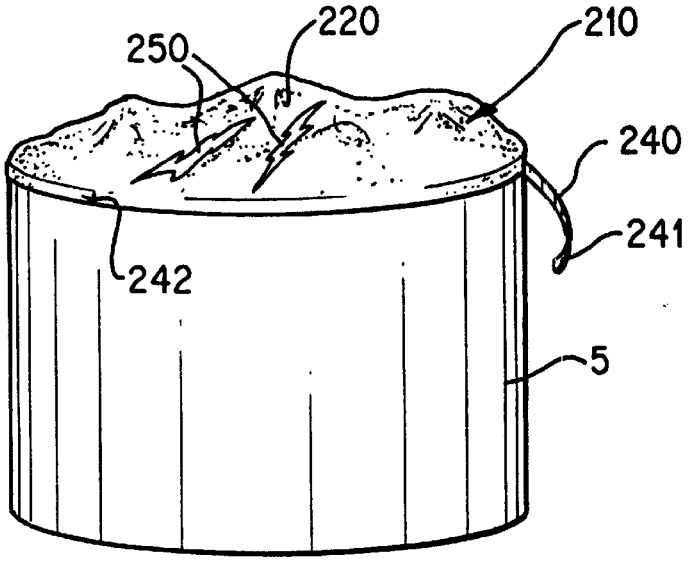

Referring now to FIGS. 5 and 6, there is shown another alternate embodiment of the subject sanitary brush cover system 210. In this embodiment, sanitary brush cover system 210 enshrouds the bristled portions 2 of a plurality of brushes 1 by covering an upper opening 6 of a brush stand 5 within which the brushes 1 are supported and stored. While FIGS. 5 and 6 show a brush stand 5 having specific structural features, brush stand 5 forms no part of the present invention. Brush stand 5 is shown only to illustrate a typical application for which the subject sanitary brush cover system 210 may be adapted in an alternate embodiment.

Sanitary brush cover system 210 in this embodiment includes a generally dome-shaped shroud member 220 having a body portion 225 composed of the fibrous, air-permeable fabric material described in relation to flexible panels 26, 27 of the preferred embodiment diagrammed in FIGS. 1 and 2. Body portion 225 which defines a brush chamber therebeneath terminates at an inlet portion 230 peripherally dimensioned and contoured to substantially contiguously engage a rim portion 5' of brush stand 5. Indicia 250 are formed or applied on an outer surface portion of shroud member 220 for identification, as well as ornamental, purposes.

Coupled to inlet portion 230 is a closure mechanism 240 formed collectively by a pair of pliable bands 241, 242 attached at diametrically-opposed locations along inlet portion 230. Pliable bands 241, 242 are formed, in the embodiment shown, of a metallic composition, though they may be formed of any other suitable material having sufficient pliability, durability, and strength to endure repeated manipulations without suffering significant loss of its mechanical properties.

After each of the plurality of brushes 1 to be stored in brush stand 5 have been returned thereto, sanitary brush cover system 210 is placed over upper opening 6 of brush stand 5 such that inlet portion 230 engages rim portion 5'. Inlet portion 230 is configured to extend slightly past the peripheral extent of rim portion 5' such that when pliable bands 241, 242 are deformed about rim portion 5', they cooperatively apply a grasping force urging segments of inlet portion 130 against a side wall portion 7 of brush stand 5 adjacent rim portion 5'. This grasping force then serves to secure the engagement of inlet portion 130 with rim portion 5'. Hence, bristled portions 2 of the brushes 1 contained within brush stand 5 are breathably and securely enclosed therein.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular combinations of elements may be reversed or interposed, all without departing from the spirit or scope of the invention as defined in the appended Claims. In addition, while the described embodiments of the subject sanitary brush cover system are directed specifically to toothbrush applications, the present invention is not necessarily limited to such applications, as the subject sanitary brush cover system finds significant application with other types of brushes where breathable covering of the bristles thereof is desired.

What is claimed is:

1. A sanitary brush cover system for breathably isolating a bristled portion of a brush from contaminant atmospheric particles and organisms comprising:

(a) a shroud member for substantially enshrouding said bristled portion of said brush, said shroud member having a body portion and an inlet portion, said body portion defining a brush chamber for receiving therein said bristled portion and having at least one flexible panel formed of an air-permeable composition substantially impermeable to said contaminant atmospheric particles and organisms, said inlet portion defining an opening for insert of said bristled portion therethrough into said brush chamber; and, (b) closure means coupled to said shroud member for selectively closing and opening said inlet portion opening, said brush chamber being substantially enclosed when said inlet portion opening is closed, said closure means including a flexible bottom panel coupled to said inlet portion, said flexible bottom panel having at least one slit formed therein for removable insert of said bristled portion of said brush therethrough.

2. The sanitary brush cover system as recited in claim 1 wherein said air-permeable composition is a fibrous fabric.

3. The sanitary brush cover system as recited in claim 1 wherein said shroud member includes indicia formed thereon.

4. The sanitary brush cover system as recited in claim 1 wherein said flexible bottom panel is formed of said air-permeable composition.

5. The sanitary brush cover system as recited in claim 4 wherein said air-permeable composition is a fibrous fabric.

6. A sanitary brush cover system for breathably isolating a bristled portion of a brush from contaminant atmospheric particles and organisms comprising:

(a) a shroud member for substantially enshrouding said bristled portion of said brush, said shroud member having a body portion and an inlet portion, said body portion defining a brush chamber for receiving therein said bristled portion and having at least one flexible panel formed of an air-permeable composition substantially impermeable to said contaminant atmospheric particles and organisms, said inlet portion defining an opening for said brush chamber; and, (b) a bottom panel member coupled to said inlet portion of said shroud member to extend across said inlet portion opening, said bottom panel member including a flexible portion having formed therein at least one slit for insert of said bristled portion of said brush therethrough.

7. The sanitary brush cover system as recited in claim 6 wherein said air-permeable composition is a fibrous fabric.

8. The sanitary brush cover system as recited in claim 7 wherein said flexible portion of said bottom panel member is formed of said air-permeable composition.

* * * * *